United States Patent [19]

van de Steeg et al.

[11] 4,416,704

[45] Nov. 22, 1983

[54] METHOD AND INSTALLATION FOR CLEANING A SQUEEGEE DEVICE

[75] Inventors: Antonius T. H. van de Steeg, St. Anthonis; Gerardus H. van Mondfrans, BN Sambeek, both of Netherlands

[73] Assignee: Stork Brabant B.V., Netherlands

[21] Appl. No.: 346,203

[22] Filed: Feb. 5, 1982

[30] Foreign Application Priority Data

Feb. 11, 1981 [NL] Netherlands ..... 8100663

[51] Int. Cl.[3] ..... B08B 3/02

[52] U.S. Cl. ..... 134/34; 134/22.12; 134/24; 134/55; 134/145; 134/152; 134/170

[58] Field of Search ..... 134/34, 24, 22.12, 54, 134/55, 135, 145, 152, 170, 177

[56] References Cited

U.S. PATENT DOCUMENTS

| | | | |
|---|---|---|---|
| 2,450,112 | 9/1948 | Buckholdt | 134/170 X |
| 3,355,324 | 11/1967 | Catzen | 134/177 X |
| 3,688,782 | 9/1972 | Smith | 134/170 X |
| 4,299,245 | 11/1981 | Clapper | 134/152 X |

*Primary Examiner*—Arthur D. Kellogg

*Attorney, Agent, or Firm*—Basile, Weintraub & Hanlon

[57] ABSTRACT

A method and installation for cleaning a squeegee device. The installation includes a housing with a door through which the squeegee device can be introduced and mounted in a tiltable supporting element. After the closing of the door the squeegee device is internally and externally flushed and rinsed by means of a number of stationary and traveling spraying nozzles through which a cleaning liquid is sprayed upon the squeegee device.

9 Claims, 6 Drawing Figures

METHOD AND INSTALLATION FOR CLEANING A SQUEEGEE DEVICE

BACKGROUND OF THE INVENTION

1. Field of the Invention

The present invention relates to a method of cleaning a squeegee device comprising a dye pipe and a squeegee blade in which both the interior and the exterior of the device are to be cleaned by spraying the device with a cleaning fluid.

2. Description of the Prior Art

A method of this kind is known which shows in a rather primitive form how the cleaning is accomplished mainly manually and the squeegee device is rinsed by spraying the same with a cleaning liquid.

Such a method presents various drawbacks, e.g. the use of a considerable amount of liquid and the time required for the spraying operation. Additionally substantial manual labour has to be effected accompanied by the spreading of a large amount of water about the surrounding area.

SUMMARY OF THE INVENTION

It is a primary object of this invention to provide an improved method of cleaning a squeegee device, which method intensifies the cleaning action and additionally offers the possibility of a certain degree of mechanization.

These objects are attained according to the invention in that the method comprises the steps of securing the squeegee device in a supporting element which is tiltably mounted in a housing, whereupon a first cleaning action takes place which consists of flushing a dye pipe from one extremity and simultaneously externally rinsing both the pipe and the squeegee blade followed by a second cleaning action consisting of flushing the dye pipe from the other extremity.

Due to these features, the interior and exterior of the squeegee device are cleaned in a single cycle during which dead-points, if any, (especially in the interior of the pipe) are cleaned in an effective manner thereby preventing any contamination of a new dye to be subsequently used in the cleaned squeegee device.

The invention is also embodied in an installation for cleaning a squeegee device for a rotary screen printing machine. In this embodiment, installation is provided with a frame comprising a supporting element for the squeegee device and spraying members for dispensing cleaning fluid. The supporting element in the installation is tiltably disposed in the frame in such a manner that the supporting element is rotatable between an inoperative and an operative position in which the latter position the squeegee device is lying substantially vertically within a housing. A connection is effected in the latter position between the squeegee device and a number of stationary spraying members, with a member of remaining spraying members being displaceable along the squeegee device.

Cleaning the squeegee device proceeds as follows:

The housing is opened, for instance, by opening a door, whereupon the supporting element is tilted toward the outside of the housing in its inoperative position. Subsequently, the squeegee device is mounted and secured in the supporting element. The supporting element is tilted backward toward its operative position during which the squeegee device is disposed vertically within the housing. The housing is then closed and the spraying members activated so that the spraying members travel around and/or along the squeegee device.

In a practical embodiment, the tiltable supporting element is constructed as a J-shaped brace comprising a pivot bearing mounted upon the frame, with such a brace being provided for one of the two extremities of the squeegee device. Tilting of the supporting element can be effected in a pneumatical or hydraulical manner.

The temporary fastening of the squeegee device in the supporting element can also be mechanized in case the supporting element is provided with two stationary brackets whereinbetween a displaceable support urges the squeegee device against the two stationary brackets.

The present invention is, more particularly, embodied in an installation for cleaning a squeegee device which comprises a dye pipe with open extremities. In this case, not only the exterior but also the interior of the squeegee device has to be cleaned. This is attained according to the present invention in that the J-shaped brace, in its inoperative position, is adapted to receive and fasten one of the two open extremities of the dye pipe, with the other extremity freely projecting beyond the housing. The brace is also provided with a spraying member situated near and directed toward the fastened open extremity of the dye pipe. The features of the present invention which are believed to be novel are set forth with particularity in the appended claims.

Other claims and many of the attendant advantages will be more readily appreciated as the same become better understood by reference to the following detailed description and considered in connection with the accompanying drawings in which like reference symbols designate like parts throughout the figures.

DESCRIPTION OF THE PREFERRED EMBODIMENTS

Figure 5:
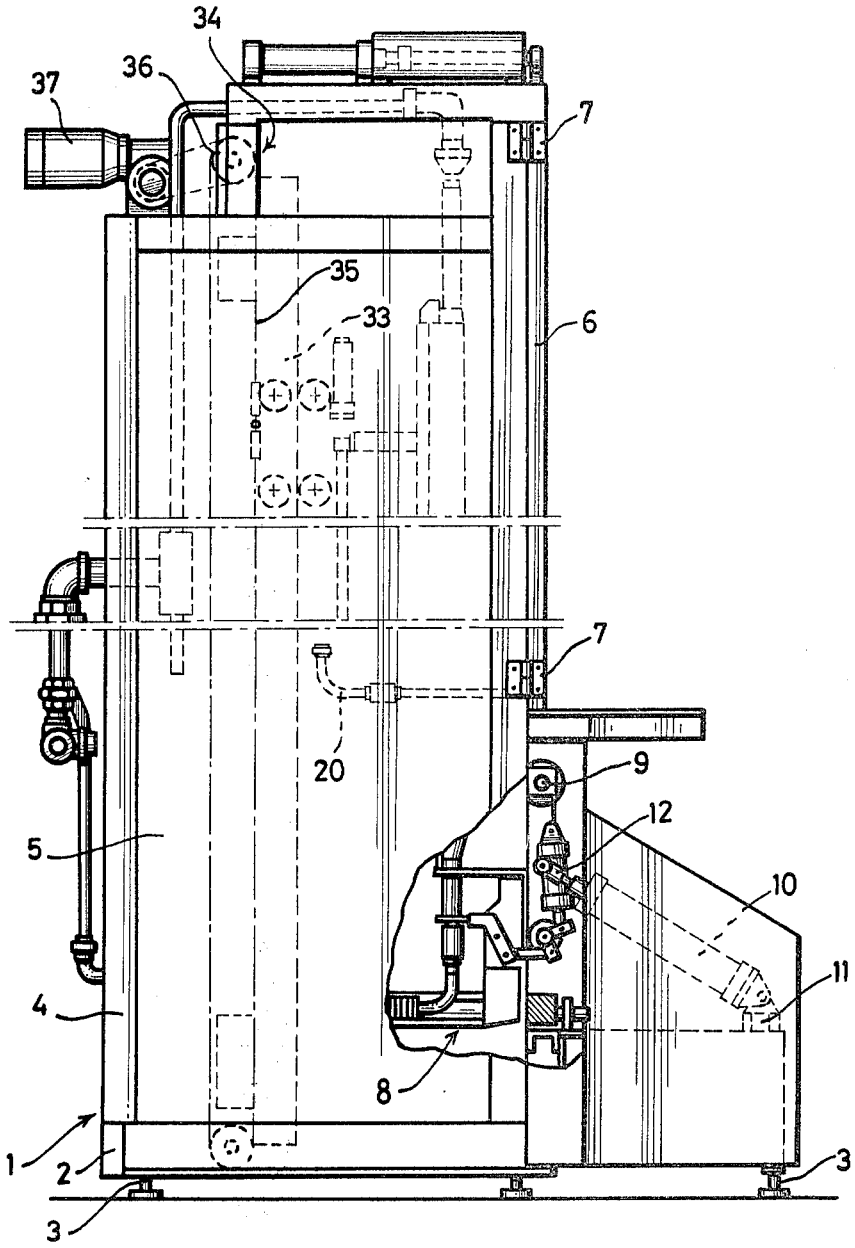
FIGS. 5 and 6 are two vertical views (also shortened) being under an angle of 90° with respect to one another and the casing of the housing being partially exploded for clarity.
Figure 6:
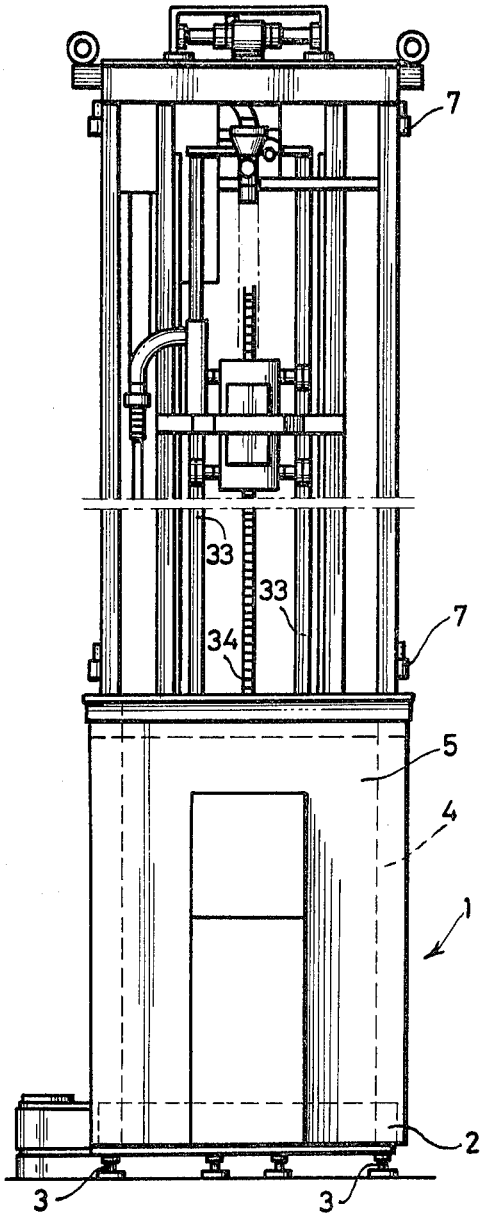

Referring now to FIGS. 5 and 6, the installation consists of a frame 1 formed by a base 2 with adjustable legs 3. A number of uprights 4 are provided upon the base 2 in order to support the internal parts and the housing 5. In FIG. 6, the front of the installation can be opened by means of a door 6 suspended from pivots 7. Within the housing 5, a supporting element 8 is provided and is tiltable in the frame 1. The tilting of the supporting element 8 occurs via a pivot 9 mounted above the base 2 at a predetermined level. The tilting movement is obtained by means of a cylinder 10 pivotally connected at its cover side to a bracket or cantilever 11 on the frame 1. The piston rod 12 of the cylinder 10 is fastened to the supporting element 8 at point 13.

Figure 2:
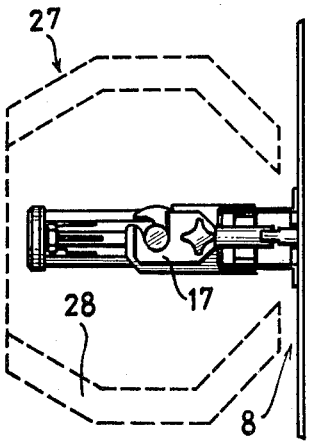

The tiltable supporting element 8 is constructed as a J-shaped brace, the connecting center of which consists of pipes 14. The supporting element 8 is designed to receive a squeegee device 15 and is for that purpose provided with two stationary supporting brackets 16 and 17 whereinbetween a displaceable support 18 urges the squeegee device 15 between the two brackets 16 and 17. FIG. 2 is a view of the bracket 17 from which it is shown that the squeegee device 15 can be slid laterally into a supporting place of the bracket 17.

Figure 4:
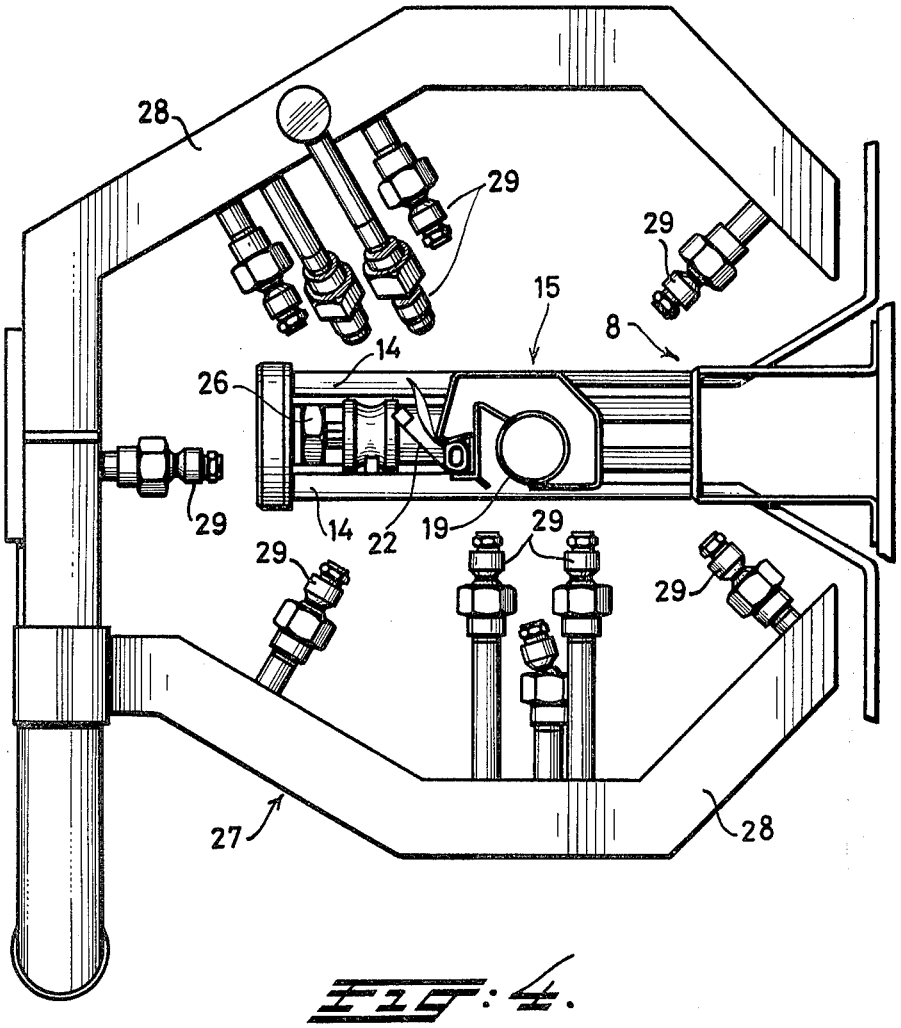
FIG. 4 is a cross sectional view, on an enlarged scale, according to line IV—IV in FIG. 1.

The squeegee device 15 consists in a known manner of a dye pipe 19, FIG. 4, having open extremities 20 and 21. The central part of the pipe 19 is provided with the main portion of the squeegee blade 22. The extremity 20 of the dye pipe 19 disposed in the supporting element 8 comprises a curved part which bears against the bracket 16.

In FIG. 5 the inoperative position of the supporting element 8 is illustrated in dotted lines. At that position and with the door 6 of the housing 5 disposed in the open position, the extremity 20 of the dye pipe 19 may be slid horizontally into the supporting element and fastened thereto by means of the brackets 16 and 17 and the support 18. The support 18 is rotatable by means of a pivotable linkage 23 and an actuating cylinder 24, FIG. 1. In the inoperative position of the supporting element 18, the remaining part of the squeegee device 15, i.e., the squeegee 22 proper and the extremity 21, project beyond housing 5. Due to the rather high position of the pivot 9, the squeegee device 15 may be slid into the supporting element 8 at an appropriate height. At the time that the supporting element 8 has been tilted backward toward its position as denoted by the solid lines, the position of the squeegee device 15 is substantially vertical and the device 15 lies within the housing 5.

Figure 3:
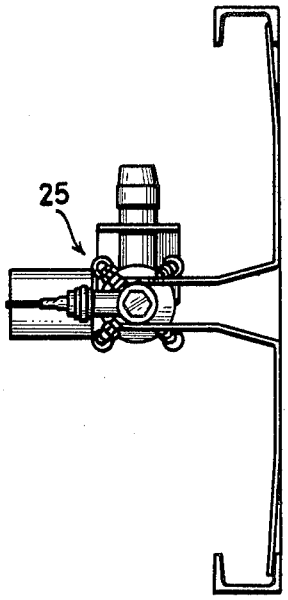
FIGS. 2 and 3 are cross sectional views according to lines II—II and III—III, respectively, in FIG. 1.

The installation is provided with a plurality of spraying members for ejecting a cleaning fluid. A first composite spraying member 25 disposed in the upper portion of the housing 5 is, in the active position of the supporting element 8, situated near and directed toward the open extremity 21 of the squeegee device 15. The spraying member 25 is clearly visible in FIGS. 1 and 3 and is, through a duct, (not shown) connected to a pump (not shown) for supplying the cleaning fluid. The spraying member 25 directs liquid jets of the cleaning fluid toward the interior and the exterior of the open extremity 21 of the dye pipe 19.

A second spraying member 26 installed in the J-shaped brace 14 near the bracket 16 is directed toward the fastened open extremity 20 of the dye pipe 19. The spraying member 26 is connected to the pump through a flexible hose (not shown). The installation further comprises a spraying member 27 displaceable along the squeegee device 15. The spraying member 27 is built up from a horseshoe-shaped pipe 28 supporting a plurality of spraying members 29. The pipe 28 bears upon the supporting member 30 which is vertically displaceable along the frame 1.

The pipe 28 is also connected to a flexible feed duct for flow of a cleaning fluid (not shown). The supporting member 13 is constructed as a trolley 31 and is provided with guide members or wheels 32 in order to cooperate with several vertical profiles 33 (see FIGS. 5 and 6). The trolley 31 is connected to a climbing-mechanism 34 in order to perform an up and down displacement corresponding to the total length of the squeegee device 15. The climbing-mechanism 34 consists of a toothed endless belt 35 slung around two guide wheels 36 situated in the base 2 and near the upper side of the installation, respectively. The top guide wheel 36 is connected to a drive motor 37 in order to accomplish the displacement of the spraying member 27.

Figure 1:
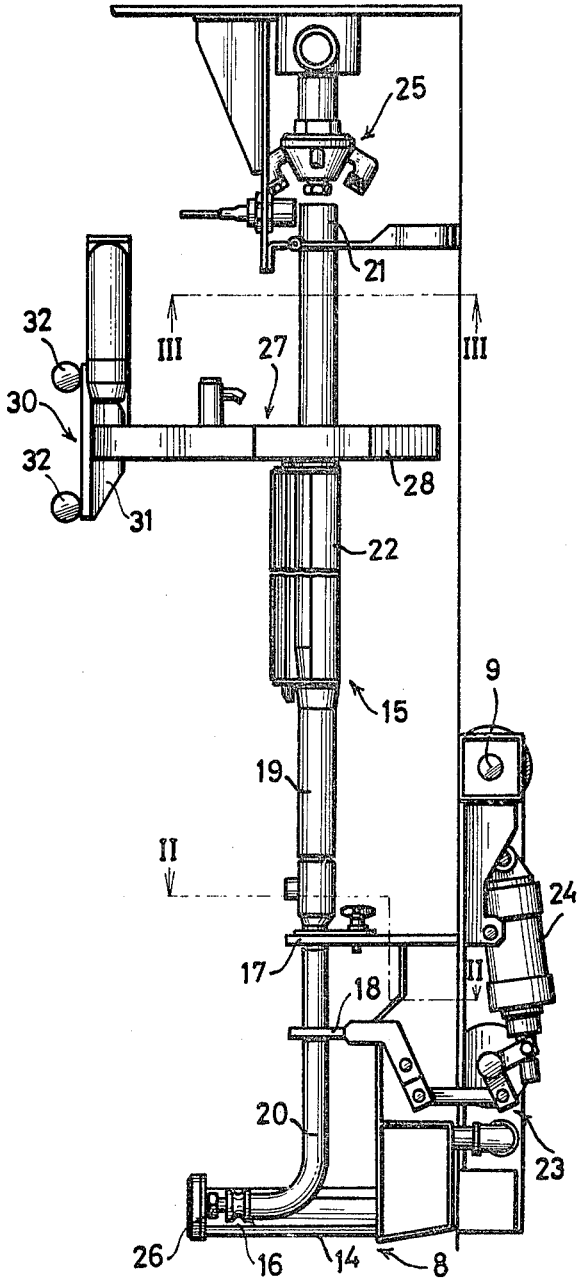
FIG. 1 is a shortened vertical view of the most important parts of the installation, with the supporting element containing a squeegee device being in its operative position.

Cleaning the squeegee device 15 proceeds as follows:

After a completed tilting of the supporting element 8 toward the position shown in FIG. 1, the door 6 of housing 5 is closed. Hereupon cleaning can take place automatically in that the door 6 is initially locked and the spraying members 25 and 26 become operative. The initial position of spraying member 27 is below the J-shaped supporting element 8, with the spraying member 27 subsequently traveling in an up and down path along the entire length of the squeegee device 15. In this manner, a first cleaning of both the interior and exterior of the squeegee device 15 is obtained. Subsequently, spraying member 26 is energized by means of which a powerful fluid flow is passed through the pipe 19 in a reverse direction. In this manner any locations within pipe 19 which have not been contacted sufficiently by fluid from the spraying member 25, are presently contacted and cleaned extremely effectively. In this connection it should be noted that the pipe 19 is provided with perforations along the squeegee blade 22, with the distance between the spraying member 26 and the curved extremity 20 of the pipe 19 being small. Due to this latter feature, any used cleaning fluid is able to escape from the pipe 19.

After all spraying members have been discontinued, the door 6 can be unlocked and opened. Energization of the cylinder 10 causes the supporting element 8 to be tilted toward its inoperative position. After the actuating cylinder 24 has been energized, the cleaned squeegee device 15 can be detached from the supporting element 8 and replaced by another squeegee device 15 to be cleaned.

The use of the method according to the present invention enables an automation of the above-listed cycle of actions. For that purpose pressure switches are utilized which cooperate with extremity 21 of the squeegee device 15. At the moment of having attained the active position (as illustrated in FIG. 1), the locking of the door 6 and the fluid feed toward the spraying members 25 and 27, as well as motor 37, can be energized. At the time that spraying member 27 has returned into its lowermost position, the action of spraying members 25 and 27 is terminated, while spraying member 26 can then be energized for a given lapse period of time. After door 6, cylinder 10 can be energized by means of pressing a button (not shown). As a precautionary measure, the pressure fluid feed to cylinder 10 will be terminated instantly, when the button is released.

It should be noted that the pressure under which the cleaning fluid is fed toward spraying members 25 and 27 amounts to, for instance, 10–12 atmospheres, the pressure for spraying member 26 being higher and amounting to, for example, 16 atmospheres.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A method of cleaning a squeegee device including a dye pipe and a squeegee blade comprising the steps of:

securing the squeegee device in a supporting element which is tiltably mounted in a housing;

flushing the pipe from one extremity and simultaneously externally rinsing both the pipe and the squeegee blade; and flushing the pipe from the other extremity.

2. The method of claim 1 further including the step of:

tilting the supporting element after the squeegee device has been secured therein toward an operative position in which both extremities of the pipe are situated opposite a spraying nozzle for dispensing a cleaning fluid, the entire squeegee device being situated within the path of a group of reciprocating spraying nozzles.

3. An installation for cleaning a squeegee device comprising:

a housing;

a frame mounted within the housing;

a supporting element for receiving a squeegee device, the supporting element being tiltably mounted on the frame and movable between an inoperative position in which the squeegee device is exposed externally of the housing and an operative position in which the squeegee device is disposed substantially vertically within the housing;

a plurality of spraying means stationarily mounted within the housing for spraying the interior and exterior of the squeegee device; and a plurality of spraying means movable within the housing along the length of the squeegee device for dispensing cleaning fluid over the exterior of the length of the squeegee device.

4. The installation of claim 3 wherein the tiltable supporting element is constructed as a J-shaped brace pivotally supported on the frame and a plurality of stationary brackets for mounting one of the two extremities of the squeegee device on the supporting element.

5. The installation of claim 4 in which the supporting element is provided with two stationary brackets and a displaceable support urging the squeegee device against the two stationary brackets.

6. The installation of claim 4 wherein the squeegee device comprises a dye pipe having open extremities, the J-shaped brace being in its operative position adapted to receive and fasten one of the two open extremities of the dye pipe on the frame, the other extremity of the squeegee device freely projecting outside the housing, a spraying member mounted on the brace and directed toward the fastened open extremity of the dye pipe.

7. The installation of claim 6 wherein the housing comprises a spraying member which, in the operative position of the supporting element, is situated at and directed toward the other extremity of the squeegee device.

8. The installation of claim 3 in which a horseshoe-shaped pipe supports the plurality of movable spraying members, and said horseshoe-shaped pipe being installed upon a displaceable supporting member movable vertically along the frame, said horseshoe-shaped pipe further being connected to a feed duct for cleaning fluid.

9. The installation of claim 8 wherein the displaceable supporting member is constructed as a trolley provided with guide members for movement along vertical profiles, said trolley further connected to a climbing-mechanism for effecting its up and down displacement of the trolley along the length of the squeegee device.

* * * * *